US008206233B2

(12) United States Patent
Baker

(10) Patent No.: US 8,206,233 B2
(45) Date of Patent: Jun. 26, 2012

(54) WRIST POSITIONING ATHLETIC DEVICE

(76) Inventor: Jonathan D. Baker, Anchorage, AK (US)

( * ) Notice: Subject to any disclaimer, the term of this patent is extended or adjusted under 35 U.S.C. 154(b) by 0 days.

(21) Appl. No.: 13/230,491

(22) Filed: Sep. 12, 2011

(65) Prior Publication Data

US 2012/0004046 A1 Jan. 5, 2012

Related U.S. Application Data

(63) Continuation of application No. 12/547,172, filed on Aug. 25, 2009, now abandoned.

(60) Provisional application No. 61/091,776, filed on Aug. 26, 2008.

(51) Int. Cl.
*A63B 69/36* (2006.01)
*A63B 69/38* (2006.01)

(52) U.S. Cl. ..... 473/213; 473/212; 473/464

(58) Field of Classification Search ..... 473/207, 473/212, 213, 214, 226, 227, 276, 459, 464, 473/553, 549, 551

See application file for complete search history.

(56) References Cited

U.S. PATENT DOCUMENTS

| | | | | |
|---|---|---|---|---|
| 3,693,973 | A * | 9/1972 | Wattenburg | 473/463 |
| 3,700,245 | A * | 10/1972 | Nannini | 473/213 |
| 4,245,841 | A * | 1/1981 | Owens, Jr. | 473/212 |
| 4,445,686 | A * | 5/1984 | Daugherty | 473/464 |
| 6,553,997 | B2 * | 4/2003 | Illas | 128/878 |
| 7,435,196 | B2 * | 10/2008 | Darmohusodo et al. | 473/464 |
| 7,510,480 | B2 * | 3/2009 | Lesko | 473/212 |
| 2007/0155523 | A1 * | 7/2007 | Lesko | 473/212 |

* cited by examiner

*Primary Examiner* — Nini Legesse
(74) *Attorney, Agent, or Firm* — Workman Nydegger

(57) ABSTRACT

An apparatus for teaching and practicing the proper positioning of the hands and/or wrists relative to the arms in the performance of an athletic maneuver is disclosed. The apparatus includes a brace to be positioned on the forearm and extend across the wrist and at least partially along the hand. A securing mechanism can be included for selectively attaching the brace to the forearm. A rod extends from the brace and is configured to be gripped by the user while wearing the device. The rod can also receive athletic related devices. The device can be adapted to teach a user the proper positioning of the hands and wrists relative to the arms throughout an athletic maneuver.

20 Claims, 8 Drawing Sheets

WRIST POSITIONING ATHLETIC DEVICE

CROSS-REFERENCE TO RELATED APPLICATIONS

This application is a continuation of U.S. patent application Ser. No. 12/547,172, filed Aug. 25, 2009, now abandoned entitled WRIST POSITIONING ATHLETIC DEVICE, which claims priority to and the benefit of U.S. Provisional Patent Application No. 61/091,776, filed Aug. 26, 2008, entitled WRIST POSITIONING GOLF DEVICE, which is incorporated herein by reference in its entirety.

BACKGROUND OF THE INVENTION

1. The Field of the Invention

The present invention relates generally to sports training equipment. More particularly, the invention relates to an athletic instructional device adapted to teach an individual the proper positioning of the hands and wrists relative to the arms throughout an athletic maneuver. The invention has particular application in golf where it can be adapted to teach a golfer the proper positioning of the hands and wrists relative to the arms throughout a golf swing.

2. The Relevant Technology

Golf is a game enjoyed by many but mastered by few. For this reason, golfers who wish to improve their game often turn to golf aids, instructional videos, lessons from golf professionals, instructional books, and practice time on the driving range or putting green so that they are better prepared to play a round of golf. However, because these learning aids are typically not suitable to be used while playing an actual round of golf, the practice with these aids and the lessons learned from them are only beneficial if they are engrained into the memory or muscular reflexes of the golfer.

Many learning aids and much of the instruction available to golfers is ineffective because they fail to engrain the proper swing motion into the golfer's memory. For example, a golfer may receive instruction from a video, book, or golf professional. During the instruction, the golfer can compare his or her swing motion to that demonstrated on the video, in the book, or by the professional. However, merely observing and trying to duplicate a proper golf swing from a video, book, or demonstrated by a professional does not effectively engrain the copied motion in the golfer's memory. When the golfer is practicing or playing without the instructional material or golf professional, the golfer may not realize that his or her swing motions are inconsistent with those demonstrated by the instructional material or golf professional. Thus, as the golfer practices and/or plays without the instructional material or golf professional, it is very likely that the golfer will unconsciously return to his or her old swing habits.

One of the most common problems for amateur golfers is allowing their wrists to unhinge too early in the downswing as the head of the golf club approaches the golf ball. This premature unhinging or "casting" of the wrists causes a significant loss of power in the golf swing, thereby reducing how far the golf ball can be hit. Premature casting of the wrists can also lead to inconsistency in being able to control the flight of the golf ball. For example, casting can lead to hitting the ground before hitting the ball, pulling the ball (e.g., hitting the ball to the left for a right handed golfer), or hooking the ball (e.g., hitting the ball so that it curves sharply to the left in the air for a right handed golfer).

In contrast, nearly all professional golfers have the ability to maintain the angle between their arms and their wrists on the downswing. When their arms are parallel to the ground on the downswing, the shaft of the club is still pointing straight up in the air and their wrists are still hinged. Conversely, many amateurs who have the casting problem will have the club straight in line with their arms, having the club also parallel to the ground when their arms are parallel to the ground. This causes a significant loss in power as well as some of the other problems identified above.

A number of exercises have been created to help golfers stop casting. For example, one possible way of fixing the casting problem is to practice swinging a club upside down, and trying to get the "woosh" sound to happen just after where impact with a golf ball would be, instead of before it. Golfers are also instructed to place a headcover about 18 inches behind the golf ball and practice hitting the ball without touching the headcover. This requires a golfer to stop casting and have more power in his or her swing. These exercises, though, are ineffective in engraining the proper motion into a golfer's memory or muscular reflexes.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

The present invention relates generally to sports training equipment. More particularly, the invention relates to an athletic instructional device adapted to teach an individual the proper positioning of the hands and/or wrists relative to the arms throughout an athletic maneuver. The invention has particular application in golf where it can be adapted to teach a golfer the proper positioning of the hands and wrists relative to the arms throughout a golf swing. It will be recognized, however, that the invention has a broader range of applicability. For example, the invention can be employed wherever an individual requires teaching or practice concerning the proper positioning of the hands and/or wrists relative to the arms in an activity, including, but not limited to, tennis, baseball, softball, badminton, racquetball, table tennis, fishing, and the like. The invention can also be used as a simple exercise device to build arm, wrist, hand, and/or shoulder strength.

An athletic instruction device that is adapted to teach a user the proper positioning of the hands and wrists relative to the arms in an athletic maneuver according to an exemplary embodiment of the present invention comprises a brace adapted to be positioned on a user's forearm and extend across the wrist and at least partially along the hand. The brace can have a securing mechanism adapted to selectively secure the brace to the user's forearm. A rod can extend from the brace adjacent one end thereof so that the user can grasp the rod when the brace is positioned on the forearm. The rod can be configured to receive or have an athletic related device attached thereto.

In another exemplary embodiment, an athletic instructional device includes means for maintaining a first hand of an athlete in a desired orientation relative to a first forearm of the athlete during an athletic maneuver. The means for maintaining can include a brace and a rod that are formed at a generally right angle. The device can also include a securing mechanism for selectively coupling the means for maintaining to the first forearm or first hand of the athlete. The securing mechanism can include hook and loop type fasteners, stretchable fabrics, and the like. Furthermore, the device can also include means for attaching an athletic device to the means for maintaining In one embodiment, the means for maintaining includes the means for attaching. For example, in one embodiment, the means for attaching comprises the rod of the means for maintaining.

Another exemplary embodiment of the present invention includes a method for learning the proper positioning of a hand and a wrist relative to a forearm during an athletic maneuver. The method includes securing a brace to a first forearm of an athlete so that the brace extends at least partially along the first forearm, a first wrist, and a first hand of the athlete. The athlete then grasps a rod with the first hand. The rod and brace are coupled together to maintain the first hand in a desired orientation relative to the first forearm. The athlete then performs the athletic maneuver. Throughout the performance of the athletic maneuver, the first hand and the first forearm are maintained in the desired orientation, thereby training the athlete's muscles to properly perform the athletic maneuver.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The present invention relates generally to sports training equipment. More particularly, the invention relates to an athletic instructional device adapted to teach an individual the proper positioning of the hands and wrists relative to the arms throughout an athletic maneuver. The invention has particular application in golf where it can be adapted to teach a golfer the proper positioning of the hands and wrists relative to the arms throughout a golf swing. It will be recognized, however, that the invention has a broader range of applicability. For example, the invention can be employed wherever an individual requires teaching or practice concerning the proper positioning of the hands and/or wrists relative to the arms in an activity, including, but not limited to, tennis, baseball, softball, badminton, racquetball, table tennis, fishing, and the like. The invention can also be used as a simple exercise device to build arm, wrist, hand, and/or shoulder strength.

Although the principles of the invention can be adapted to other sports or activities where the positioning of the hands and/or wrists relative to the arms is important in a maneuver for that sport, the present invention will be described herein as a golf training and exercising device. More specifically, the present invention is primarily described in terms of golf and how a golfer can improve his or her golf swing using the present invention. It will be appreciated, though, that the present athletic instructional device can be used for any sport or activity where the positioning of the wrists and/or hands relative to the arms is important. Thus, reference to the athletic instructional device as a golf training device or as a device to improve a user's golf swing should not be construed as limiting the scope of the present invention.

Figure 1:
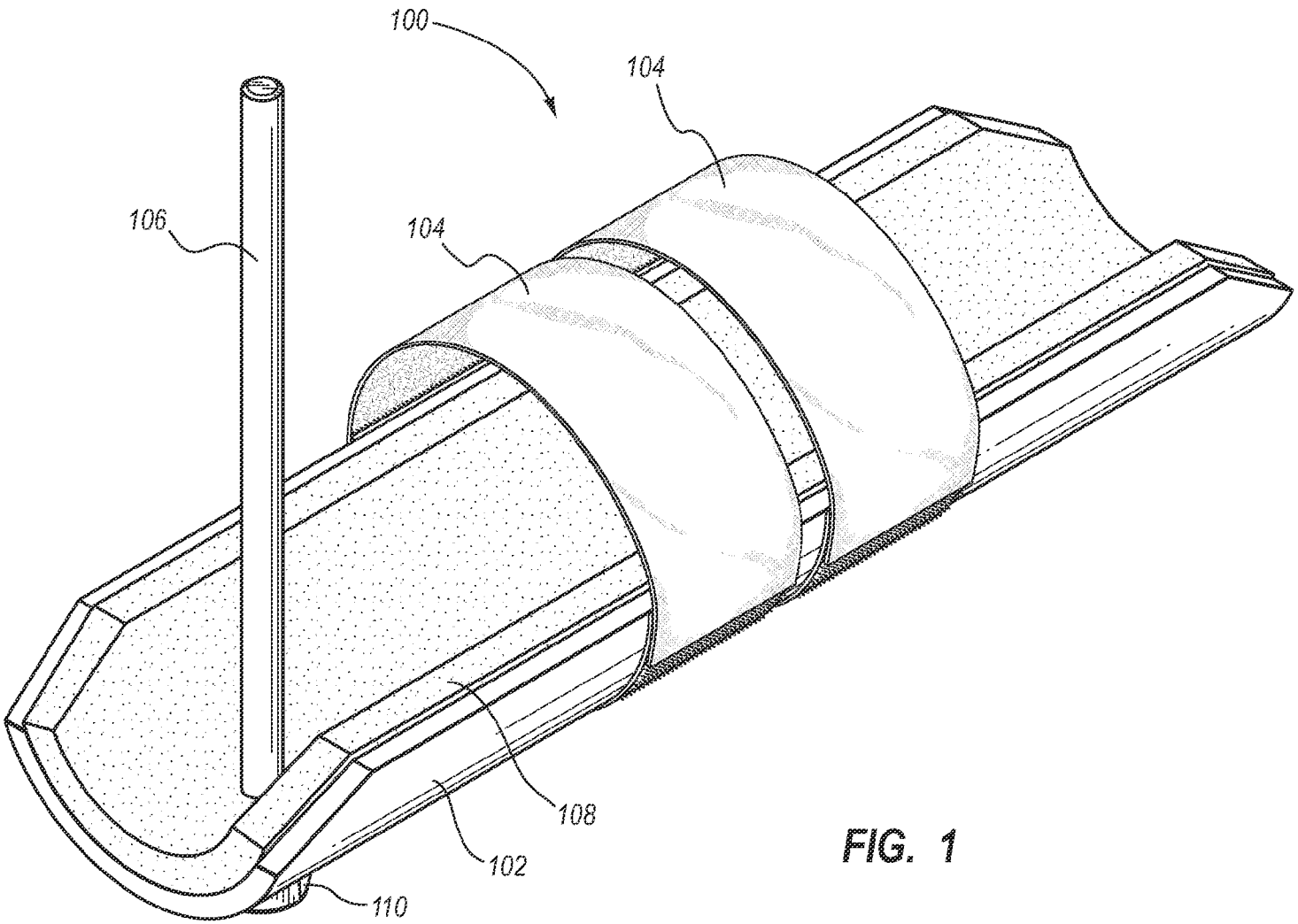
FIG. 1 illustrates a perspective view of an athletic instructional device according to an exemplary embodiment of the present invention.

Depicted in FIG. 1 is an athletic instructional device 100 according to an exemplary embodiment of the present invention. The embodiments illustrated in the figures are merely exemplary and are not intended to limit the scope of the present invention. Rather, one of ordinary skill in the art will appreciate that modifications, alternatives, and variations can be made to the illustrated embodiments without departing from the scope of the present invention.

As shown, the present athletic instructional device 100 includes a brace 102, one or more securing mechanisms 104, and a rod 106. In addition, the device 100 can further include cushioning 108 to provide greater comfort to the user. In this embodiment, brace 102 comprises a longitudinal channel that is generally semicircular in shape when viewed from an end (see FIGS. 9-10). The brace 102 is adapted to be positioned on the user's forearm and extend past the wrist and at least partially along the side of the hand. As will be described in greater detail below, this configuration of brace 102 assists in maintaining the user's wrists and hands in the proper position relative to his or her arms throughout an athletic maneuver, such as a golf swing.

Although brace 102 is depicted as being generally semicircular in shape when viewed from an end, brace 102 may be any shape that can be positioned on the golfer's forearm, including, but not limited to, ovular, rectangular, square, trapezoidal, and the like. Optionally, brace 102 can be formed so that the interior portion of brace 102 generally corresponds to the shape of the golfer's arm, wrist, and/or hand. By way of non-limiting example, brace 102 can be wider at one end to accommodate the user's forearm while narrowing at the other end to more closely conform to the size of the golfer's wrist/hand.

In one exemplary embodiment, brace 102 is formed of four-inch PVC pipe which has been cut in half longitudinally. It will be appreciated, however, that brace 102 can be formed of any suitable material, including plastics, metals, alloys, composites, ceramics, and the like.

As noted above, cushioning 108 can be positioned with brace 102. Cushioning 108 can increase the comfort of wearing and using the athletic instructional device 100. Furthermore, cushioning 108 can also assist in forming the interior of brace 102 so as to generally correspond to the shape of the golfer's arm, wrist, or hand. Any suitable cushioning can be used in brace 102. By way of non-limiting example, cushioning 108 can comprise foam, cloth, plastic, rubber, polymers, and the like. Cushioning 108 can be removably placed in brace 102 or can be permanently secured within brace 102 by any suitable means, including adhesives, such as glue or tape, clips, pins, hook and loop type fasteners, and the like.

While each of brace 102 and cushioning 108 are illustrated as having straight, semicircular shapes, it will be appreciated that one or both of brace 102 and cushioning 108 can have other shapes. For instance, brace 102 can have a straight, semicircular shape as illustrated, while cushioning is shaped to generally conform to the shape of a user's arm/wrist/hand. Furthermore, brace 102 and cushioning 108 can be formed of discrete materials that are attached to or otherwise associated with one another. Alternatively, brace 102 and cushioning 108 can be integrally formed.

Figure 1A:
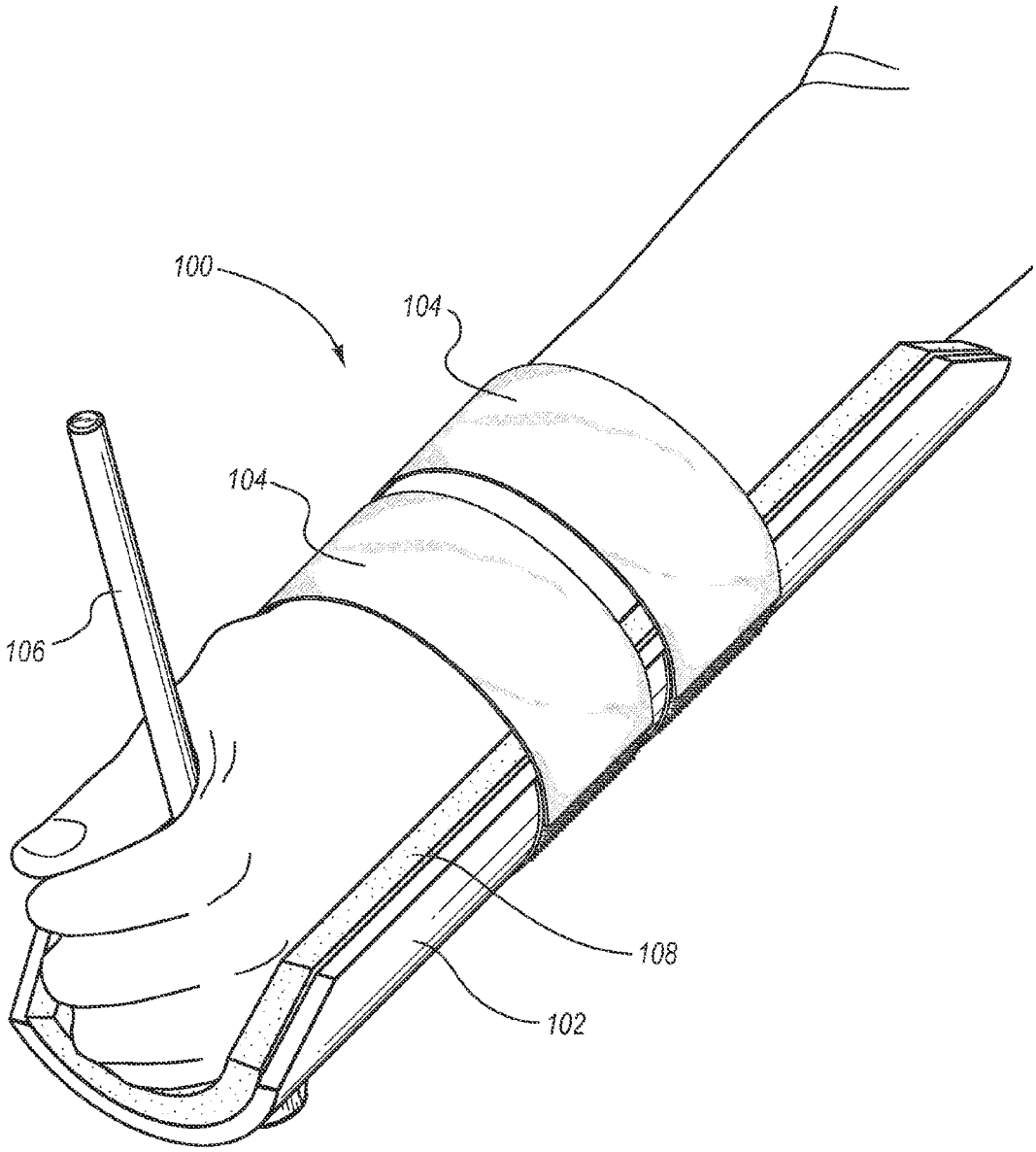
FIG. 1A illustrates a perspective view of the athletic instructional device of FIG. 1 partially secured to a user's forearm.

As noted above and as illustrated in FIG. 1, athletic instructional device 100 also includes a securing mechanism 104 for securing brace 102 to the user's forearm. In the exemplary embodiment shown in FIG. 1, securing mechanism 104 includes two straps that can be used to selectively secure brace 102 to a user's forearm. Each of the straps has a first end and a second end which attach to opposite sides of brace 102. In the illustrated embodiment, securing mechanism 104 is a hook and loop type fastening system, such as VELCRO®. More specifically, a hook-type material is secured to the outer surface of brace 102, while the securing mechanism straps 104 are formed of, or have a loop-type material that selectively engages the hook-type material on the outer surface of brace 102. Thus, a user can position his or her forearm within brace 102, as shown in FIG. 1A, and use securing mechanism 104 to selectively secure brace 102 thereon.

In other alternative embodiments, securing mechanism 104 may include adhesives, including adhesive tapes, grommets, snaps, zippers, stretchable fabrics, such as spandex, or other fasteners. Further, additional objects may be used with securing mechanism 104 to accomplish fastening of brace 102 to the user's forearm. By way of non-limiting example, when grommets are used, elastic cord, such as fixed or adjustable bungee cord, may be used to connect grommets on opposite sides of brace 102. In another embodiment, a stretchable material, such as spandex, may be attached to brace 102 such that a user can insert his or her hand/wrist/forearm between brace 102 and the stretchable material. The stretchable material can be sized, configured, and associated with brace 102 to maintain brace 102 along the forearm, wrist, and hand of the user so as to properly position the hand and wrist relative to the forearm.

While various securing mechanisms have been shown and described, it will be appreciated that any suitable device or mechanism can be used to secure brace 102 to a user's forearm without departing from the scope of the present invention. Additionally, the aforementioned securing mechanisms are each examples of means for selectively securing brace 102 to a user's forearm.

With continued reference to FIG. 1, connected to one end of brace 102 is rod 106. Rod 106 is positioned, sized, and adapted to be gripped by a golfer or to receive a golf related device thereon that is to be gripped by the golfer. Rod 106 extends from the central interior portion of brace 102. In the illustrated embodiment, rod 106 extends through a hole that is drilled in the bottom portion of brace 102 near one end thereof. Fastening mechanism 110 can be used to secure rod 106 to brace 102. In one exemplary embodiment, such as shown in FIG. 1, fastening mechanism 110 can comprises two washers and two nuts. To attach rod 106 to brace 102, rod 106 is inserted into a hole drilled in brace 102. Two washers are placed on rod 106, one adjacent the inner surface of brace 102 and the other adjacent the outer surface of brace 102. Two nuts are then threaded onto rod 106, one adjacent each washer. The nuts are then tightened to secure rod 106 in place relative to brace 102.

In other exemplary embodiments, fastening mechanism 110 comprises other mechanical fasteners besides nuts, such as adhesives (e.g., glue), welding, or any other means known in the art. Brace 102 and rod 106 can, alternatively, be formed as an integral piece such that no fastening mechanism or coupling is needed.

In the exemplary embodiment depicted in FIG. 1, rod 106 is a half inch threaded metal rod. A rod of this size can readily receive a piece of sports related equipment, as described below. However, in some embodiments, rod 106 can be formed of other materials besides metal. For instance, rod 106 can be formed of plastics, alloys, composites, ceramics, and the like. Similarly, rod 106 can be larger or smaller in size than pictured in the embodiment. By way of non-limiting example, rod 106 can have a size similar to a standard grip of a golf club, or any other athletic equipment. Rod 106 is one example of a means for attaching an athletic related device. Other means for attaching an athletic related device include, but are not limited to, hinges, holes, threaded holes, clips, clamps, and the like.

In the illustrated embodiment, the longitudinal axis of rod 106 forms a substantially right angle with the longitudinal axis of brace 102. This orientation of rod 106 relative to brace 102 assists in properly positioning the golfer's wrists and hands relative to the arms. It will be appreciated that in some embodiments, the orientation of rod 106 relative to brace 102 may be different than that illustrated in the Figures. By way of non-limiting example, rod 106 may form an acute or obtuse angle with brace 102. Rod 106 can be aligned in any direction desired or necessary to teach or practice a specific orientation of the hands and wrists relative to the arms in any sport or athletic activity. Brace 102 and rod 106, individually and collectively, are examples of means for maintaining a hand in a desired orientation relative to a forearm.

Figure 2:
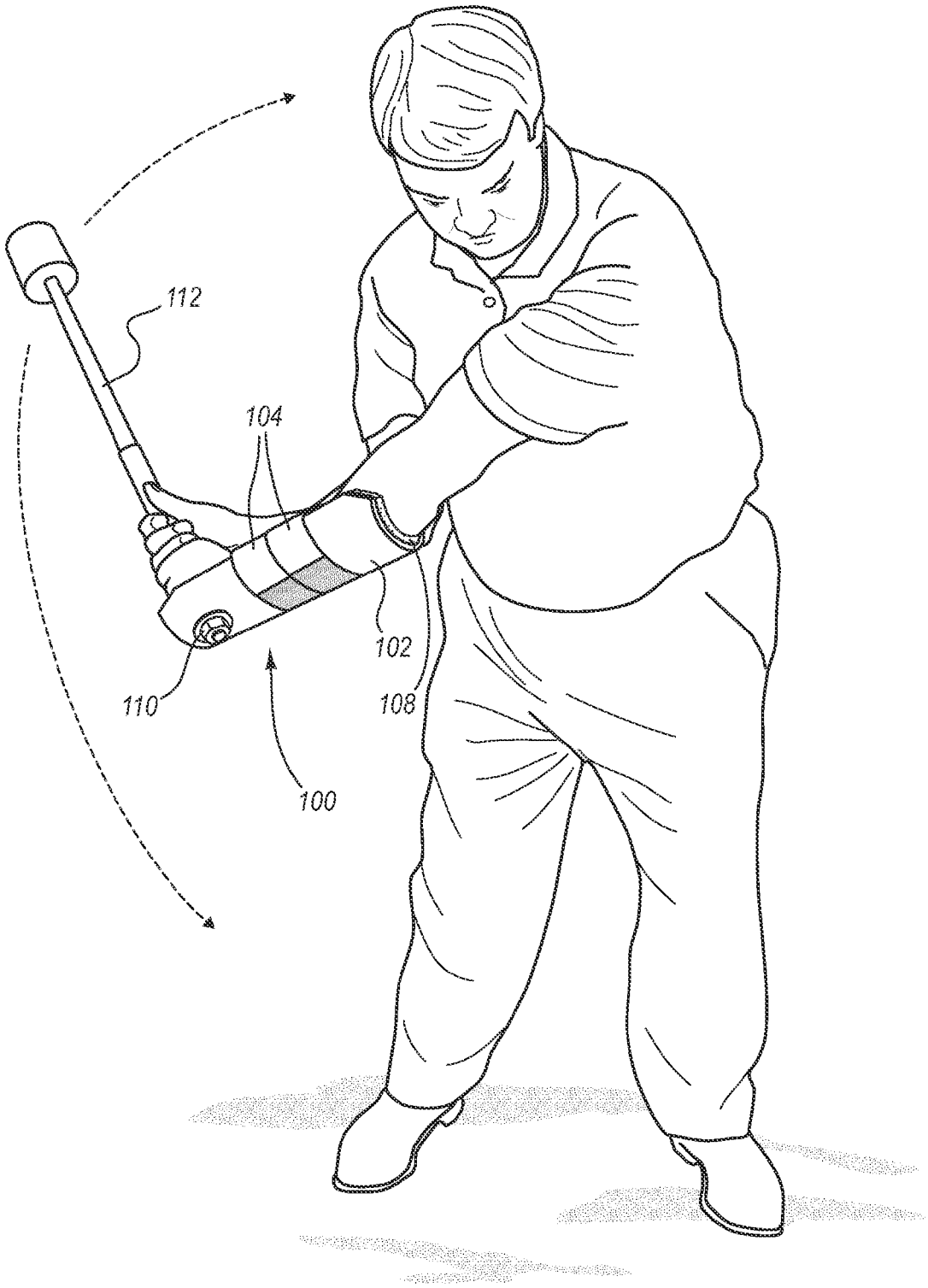
FIG. 2 illustrates a user wearing and using an exemplary athletic instructional device with a weighted golf club attached thereto.

FIG. 2 illustrates a golfer wearing and using athletic instructional device 100. As seen in the Figure, athletic instructional device 100 is mounted or secured on the left arm of the golfer. To use the athletic instructional device 100, a right handed golfer positions his or her left arm in brace 102 so that the left hand can grip rod 106. The right hand then secures brace 102 to the left arm via securing mechanism 104. In the embodiment depicted in FIG. 2, securing mechanism 104 comprises VELCRO® straps. One end of the VELCRO® straps are secured to one side of brace 102 while the other end of the straps are extended over the left arm and secured to the other side of brace 102.

While use of the wrist positioning athletic device is described herein with regard to a right handed golfer, it will be appreciated that the wrist positioning athletic device can also be used by a left handed golfer. In such a case, the wrist positioning athletic device 100 is secured on a golfer's right forearm. It will also be appreciated that the wrist positioning athletic device 100 can be manufactured in such a way that the same device can be used by both right and left handed golfers. Furthermore, the wrist positioning device 100 can be used to practice or train for any sport where proper wrist positioning can be important in an athletic maneuver for that sport, including, but not limited to, tennis, baseball, softball, badminton, racquetball, table tennis, fishing, and the like. The invention can also be used as a simple exercise device to build arm, wrist, hand, and/or shoulder strength.

Figure 3:
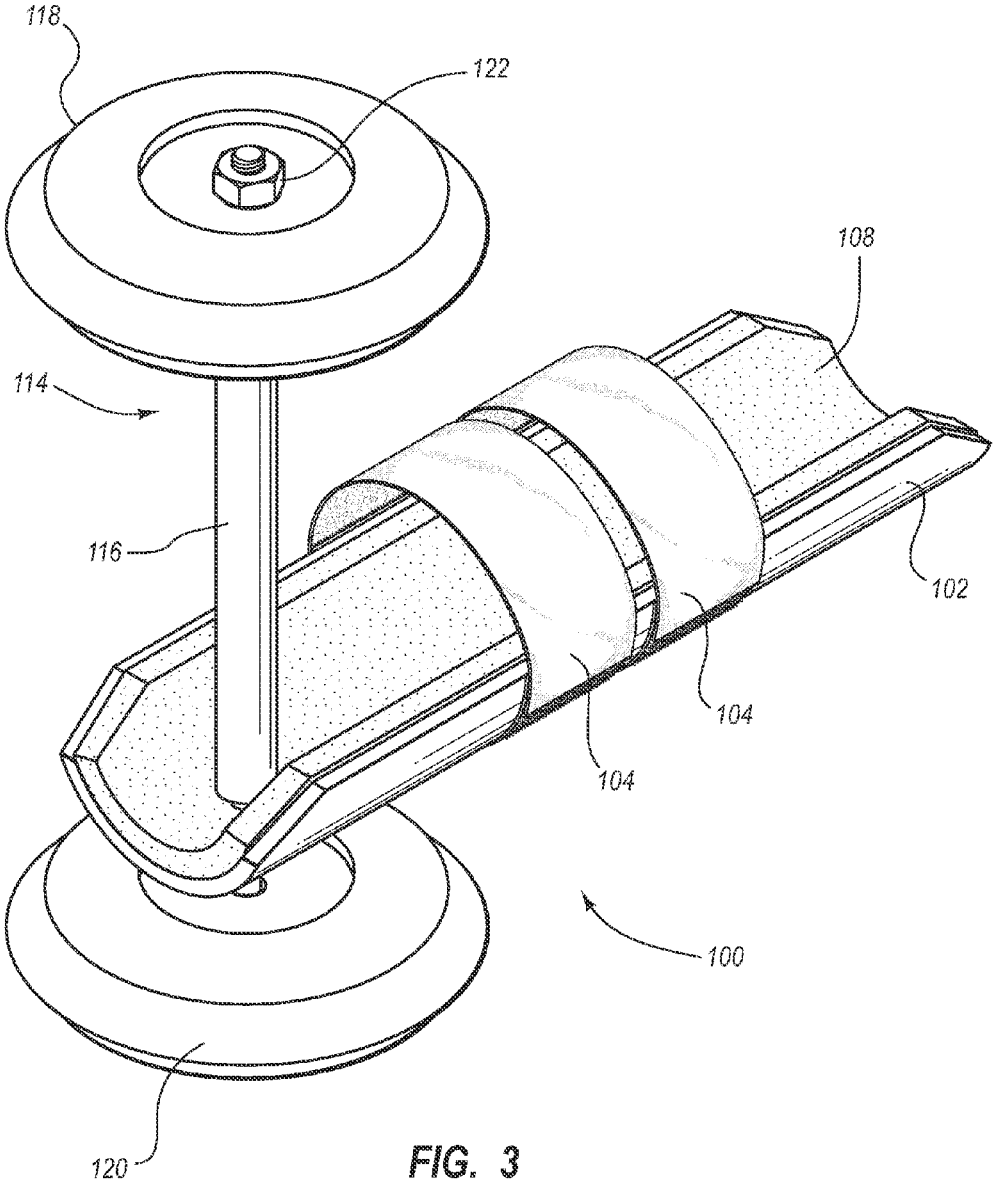
FIG. 3 illustrates an exemplary athletic instructional device with weights attached thereto.
Figure 4:
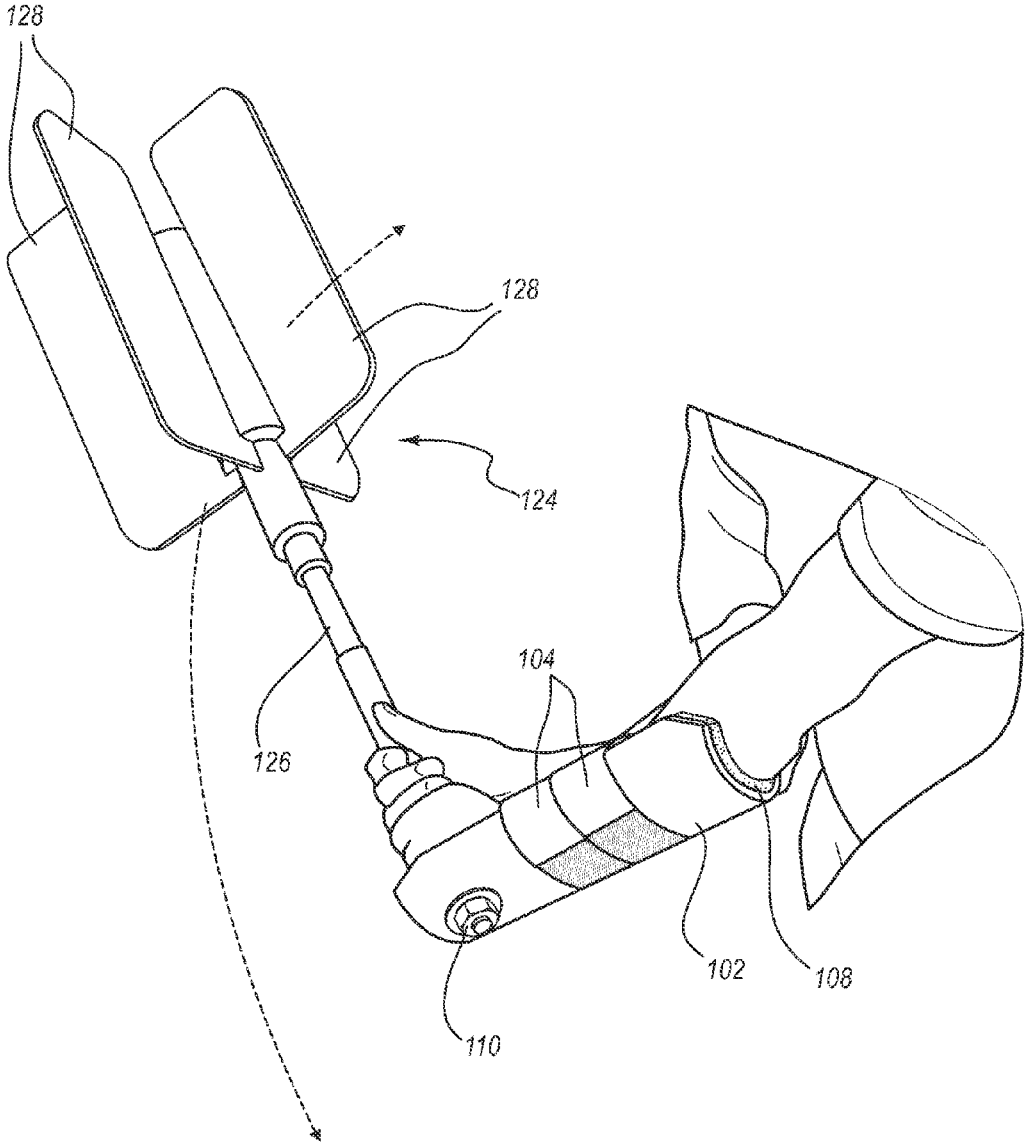
FIG. 4 illustrates a user wearing and using an exemplary athletic instructional device with a resistance fan attached thereto.

In the context of golf, once the left forearm (for a right handed golfer) is secured within brace 102 and the left hand has gripped rod 106 as described, the golfer can grip rod 106 with the right hand in the same manner he or she would with a traditional golf club. The golfer can then practice his or her golf swing as described below. Alternatively, once the left arm has been secured within brace 102 as describe, the golfer can release his or her left hand grip on rod 106 and position a piece of athletic related equipment on rod 106. For example, rod 106 can be inserted into the butt end of a weighted golf club 112, as shown in FIG. 2. The weighted golf club 112 can have a shaft with a weight attached to a distal end thereof, while the proximal end may have a gripping portion. Additionally, the proximal end may have a hole extending into the shaft. The hole may be sized and configured to receive rod 106 therein so that weighted golf club 112 can be selectively mounted on rod 106. Likewise, weight device 118 and 120 can be secured to one or both ends of rod 106, as shown in FIG. 3. Similarly, a resistance fan 124 can be mounted on rod 106, as shown in FIG. 4. Thus, rod 106 is one example of means for attaching an athletic device to brace 102.

In any case, once the athletic related device is mounted on rod 106, the golfer can grip the hand portion of the athletic related device with his or her standard golf grip. The added weight of the athletic related device provides resistance to motion as the golfer practices his or her golf swing. The increased resistance helps the golfer feel the various motions made during the golf swing, which creates muscle memory. Creation of muscle memory using the wrist positioning athletic device increases the golfer's ability to duplicate the motion when not using the device.

With athletic instructional device 100 secured on the left arm, the golfer's wrist is locked in a maximum leverage position, as depicted in FIGS. 1A, 2, and 4. More specifically, the wrist is in the maximum leverage position when the forearm forms a generally right angle with rod 106. The configuration of brace 102 and rod 106 relative to one another causes the user's wrist to be in this maximum leverage position when device 100 is secured to the user.

Athletic instructional device 100 maintains the maximum locked wrist position throughout the golf swing. That is, as the golfer sets up in his or her traditional golf stance, the wrist is locked in the maximum leverage position. As the golfer goes through the backswing, as illustrated in FIGS. 2 and 4, the wrist is maintained in the maximum leverage position while allowing for minimal rotation of the wrist. The athletic instructional device 100 will also keep the wrist in the same position throughout the downswing and follow through (see FIGS. 2 and 4). This is important because during the downswing is when many golfers allow their wrists to unhinge and extend down and away in a casting motion. As noted above, the premature unhinging of the wrists reduces the amount of power in the swing and reduces the amount of flex in the shaft of the golf club, thereby robbing the golfer of distance and accuracy.

As the golfer swings towards the impact zone, the athletic instructional device 100 still maintains the wrist in the locked position. Normally, the wrists should release or unhinge just prior to the club head hitting the golf ball. However, the athletic instructional device 100 overcompensates for the golfer's natural tendency to release early by maintaining the wrist in the locked position even through the impact zone. This overcompensation teaches the golfer's muscles to maintain the hinged wrist position longer than the golfer naturally would. Thus, after using the athletic instructional device 100, the muscles in the golfer's wrists remember to maintain the hinged, maximum leverage position longer through the downswing. Therefore, when the device 100 is not being used, the natural release of the wrists will occur just before impact rather than too early in the downswing.

FIG. 3 illustrates athletic instructional device 100 with weight device 114 attached thereto. In the illustrated embodiment, weight device 114 includes a bar 116 and weights 118 and 120. Weight device 114 can be connected to athletic instructional device 100 by sliding bar 116 over rod 106 (not shown). In some embodiments, bar 116 is screwed onto the threads on rod 106 (not shown). In the embodiment illustrated in FIG. 3, weights 118 and 120 are attached to bar 116 using fastening mechanisms similar to fastening mechanism 110. Weight 118 is attached at the far end of bar 116 with a fastening mechanism 122. Similarly, weight 120 is attached underneath brace 102 using fastening mechanism 110, which can also be used to connect rod 106 (not shown) to brace 102. In an alternate embodiment, weight 120 is attached underneath brace 102 but is fastened with a fastening mechanism that is separate from fastening mechanism 110 used to attach rod 106 (not shown) to brace 102.

With weight device 114 attached to athletic instructional device 100, a user can practice a maneuver, such as a golf swing, as described above. The addition of the weight 118 and 120 provides increased resistance in practicing the athletic maneuver, and thus provides more muscle memory as discussed above. Therefore, after practicing with athletic instructional device 100, the golfer's muscles remember to maintain the hinged, maximum leverage position longer through the downswing. When the device 100 is not being used, the natural release of the wrists will occur just before impact rather than too early in the downswing, increasing the accuracy and distance of the golf ball's flight.

FIG. 4 illustrates athletic instructional device 100 with a resistance fan 124 attached according to an exemplary embodiment of the present invention. Resistance fan 124 includes a shaft 126 and fan blades 128. Resistance fan 124 is connected to athletic instructional device 100 by sliding shaft 126 over rod 106 (not shown), as described above with reference to weighted golf club 112, for example. In some embodiments, shaft 126 is hollow and/or threaded and can be slid and/or screwed onto rod 106 (not shown). In the embodiment shown in FIG. 4, shaft 126 is similar in length, girth, composition, and texture to a traditional golf club shaft. In some embodiments, shaft 126 can comprise metal, graphite, wood, plastic, and any like rigid substance. While shaft 126 may have a grip, similar to that of a traditional golf club, for increasing the comfort of holding shaft 126, shaft 126 does not necessarily require a grip to be mounted thereon.

In the embodiment in FIG. 4, resistance fan 124 has a plurality of fan blades 128 attached to shaft 126 at the distal end thereof. In the pictured embodiment, resistance fan 124 has four fan blades 128 radially extending from shaft 126. In alternative embodiments, resistance fan 124 can have any number of fan blades 128 such that resistance is provided when the device is swung. Additionally, fan blades 128 can be angled, spaced, offset, or have any other configuration to achieve a desired resistance.

The device 100 with resistance fan 124 is used in a manner similar to that described above. Specifically, brace 102 is secured onto the user's forearm with securing mechanism 104. Resistance fan 124 is then mounted on rod 106 and the user grips shaft 126. The user can then practice the desired maneuver, such as a golf swing. The addition of resistance fan 124 provides increased resistance in practicing the desired maneuver, and thus provides more muscle memory as discussed above. Therefore, after practicing with athletic instructional device 100, the muscles in the golfer's wrists remember to maintain the hinged, maximum leverage position longer through the downswing. When the device is not being used, the natural release of the wrists will occur just before impact rather than too early in the downswing, increasing the accuracy and distance of the hit.

Figure 5:
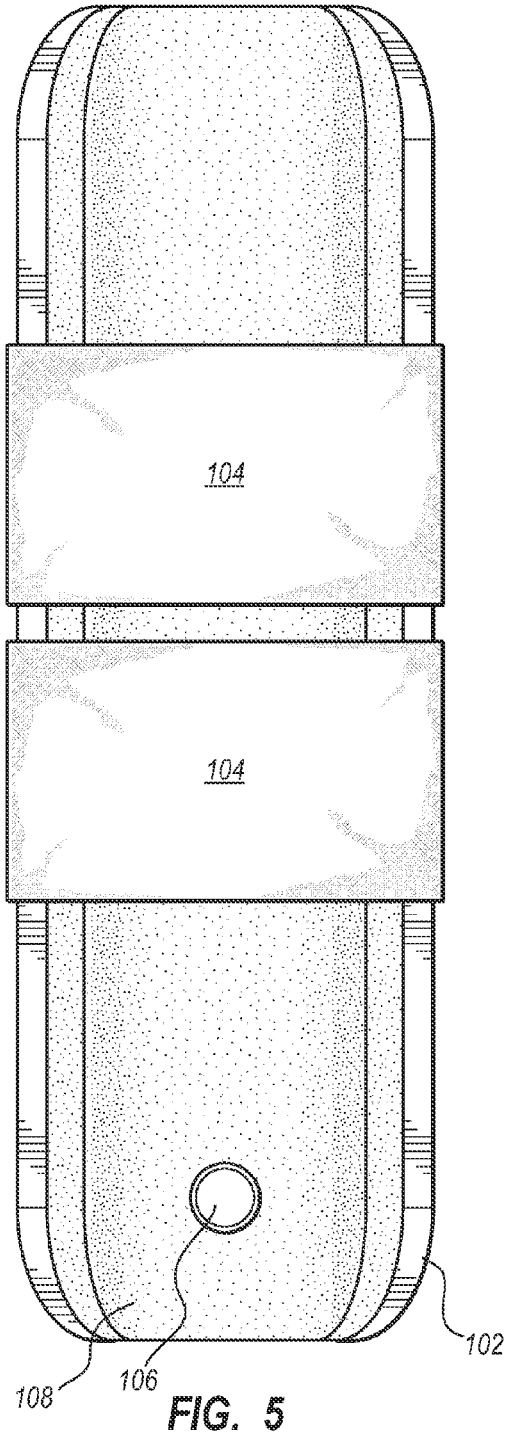
FIG. 5 illustrates a top view of an athletic instructional device according to an exemplary embodiment of the present invention.
Figure 6:
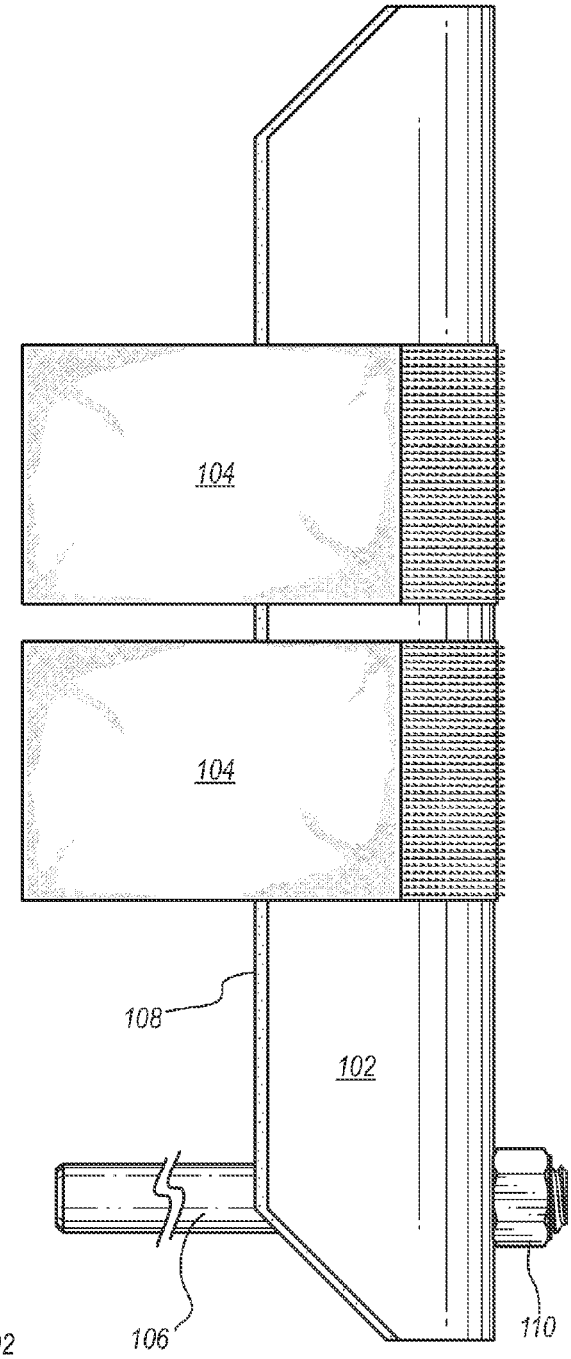
FIG. 6 illustrates a right side view of the athletic instructional device of FIG. 5.
Figure 7:
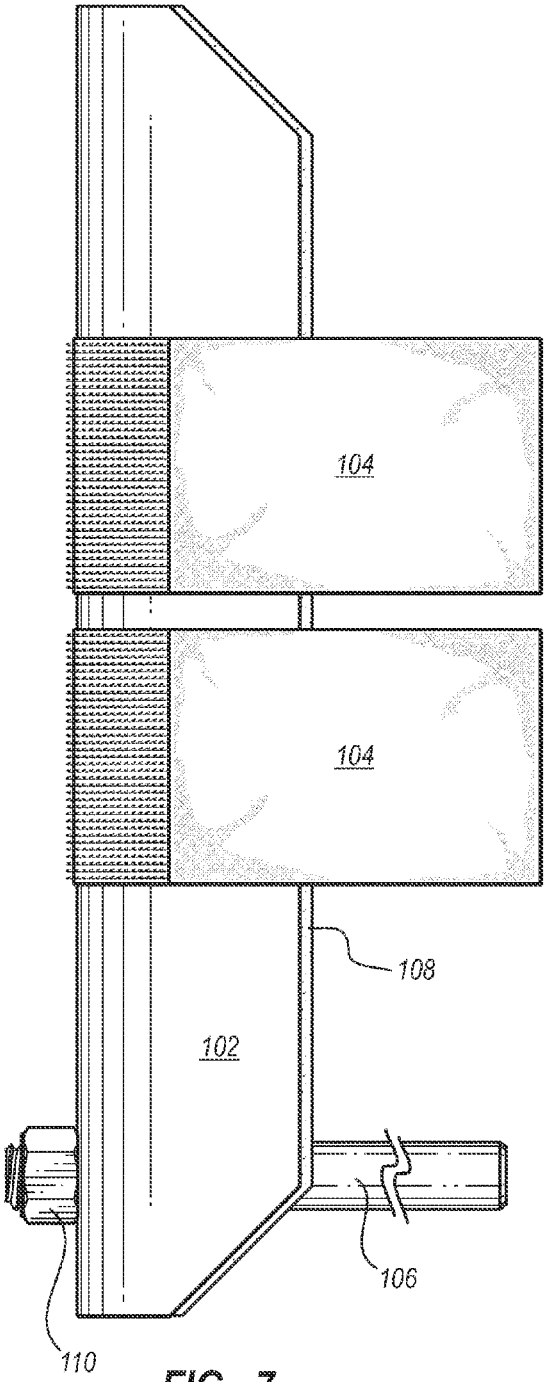
FIG. 7 illustrates a left side view of the athletic instructional device of FIG. 5.
Figure 8:
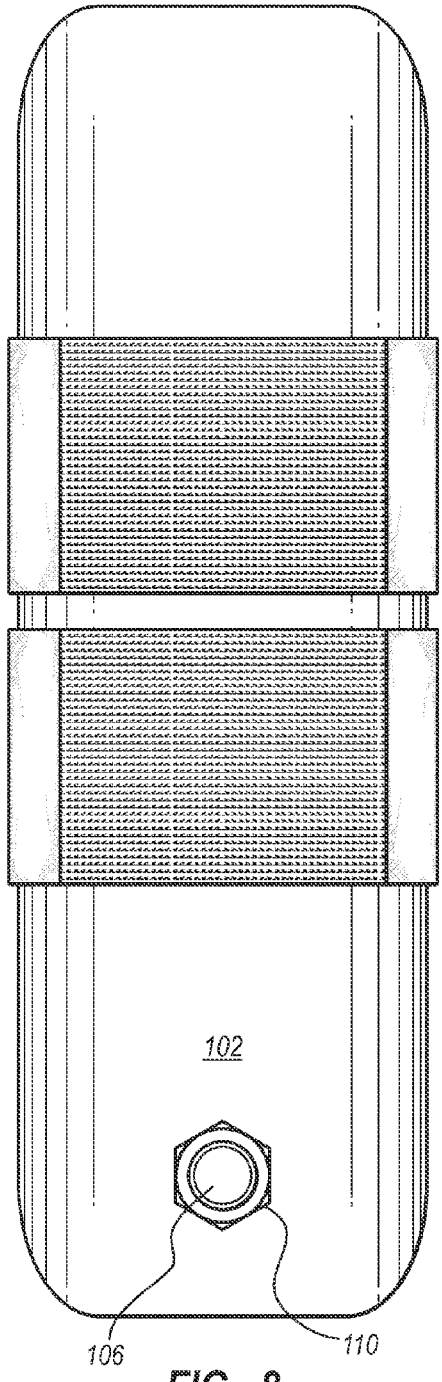
FIG. 8 illustrates a bottom view of the athletic instructional device of FIG. 5.
Figure 9:
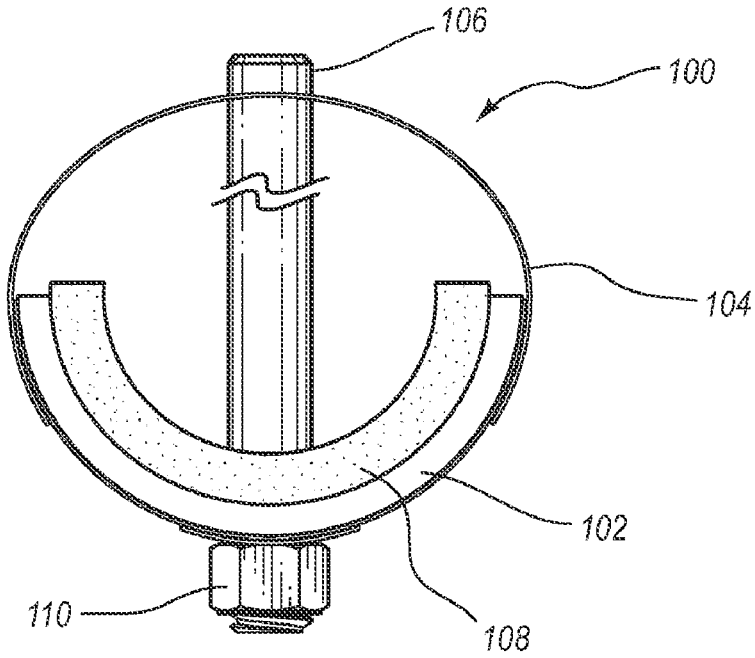
FIG. 9 illustrates a front end view of the athletic instructional device of FIG. 5.
Figure 10:
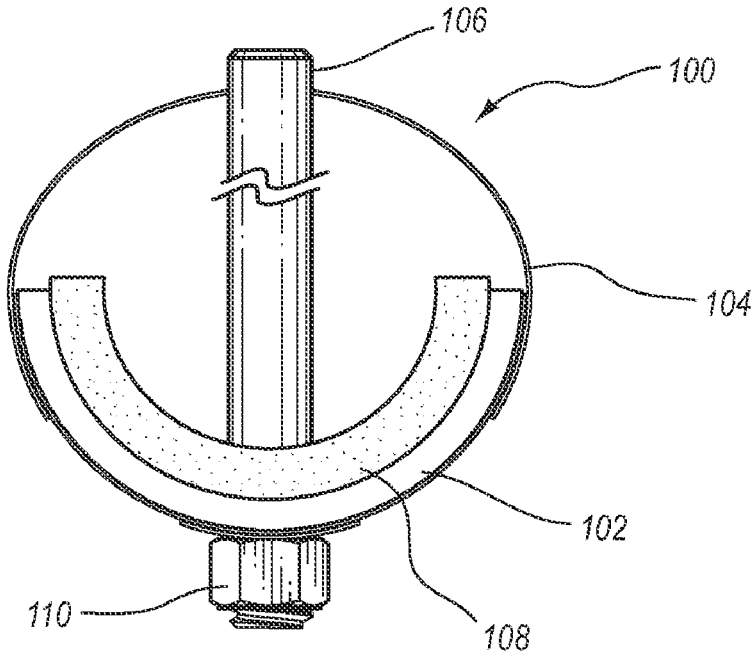
FIG. 10 illustrates a back end view of the athletic instructional device of FIG. 5.

FIGS. 5 through 10 illustrate various views of an athletic instructional device 100 according to an exemplary embodiment of the present invention. Specifically, FIG. 5 illustrates a top view, FIGS. 6 and 7 illustrate right and left views, FIG. 8 illustrates a bottom view, and FIGS. 9 and 10 illustrate end views of an athletic instructional device 100 according to the present invention. The embodiment illustrated in FIGS. 5-10 includes brace 102, securing mechanism 104, rod 106, cushioning 108, and fastening mechanism 110.

It will be appreciated that athletic instructional device 100 and/or athletic related devices, such as golf club 112, weight device 114, and resistance fan 124, can be sized and configured to be used by individuals of different sizes and abilities. For instance, brace 102 can be formed in various sizes for different sized people. For instance, brace 102 can be formed in small, medium, and large sizes so as to fit children, women, and men. Additionally, athletic related devices that are used in connection with athletic instructional device 100 can be formed for use with men, women, and children. By way of example, golf club 112 or weight device 114 can be equipped with less weight for a child, more weight for an adult woman, and even more weight for an adult man.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An athletic instructional device usable in teaching a user the proper positioning of a hand and wrist relative to a forearm during an athletic maneuver, the device comprising:

a brace having an interior portion and an exterior portion, the interior portion of the brace being receptive to at a portion of the forearm, wrist, and hand the user so as to extend at least partially along the forearm, wrist, and hand of the user;

a securing mechanism that selectively secures the brace to the user;

a rod having a first end and an opposing second end, the rod extending from the interior portion of the brace adjacent one end of the brace so that the user can grasp the rod when the brace is worn by the user, wherein the rod is coupled directly to the brace at a predetermined angle and such that the orientation of the rod and the brace remain substantially constant, thereby substantially maintaining the user's hand and wrist in a substantially constant orientation relative to the forearm during the athletic maneuver:

a first weight disposed on the exterior portion of the brace adjacent the first end of the rod, such that the brace is disposed between the first weight and the hand of the user; and a second weight disposed at the second end of the rod.

2. The athletic instructional device of claim 1, wherein the brace has a semicircular cross-sectional shape.

3. The athletic instructional device of claim 1, wherein the securing mechanism is selected from the group consisting of a hook and loop fastening system, grommets, snaps, zippers, adhesives, elastic cord, and stretchable material.

4. The athletic instructional device of claim 1, wherein the interior portion of the brace is adapted to generally correspond to the shape of the user's arm.

5. The athletic instructional device of claim 1, further comprising cushioning disposed on the interior surface of the brace so as to increase the comfort of wearing the brace.

6. The athletic instructional device of claim 1, wherein the second weight is selectively replaceable with at least one of a golf club or a resistance fan.

7. The athletic instructional device of claim 1, wherein a longitudinal axis of the rod forms a generally right angle with a longitudinal axis of the brace.

8. The athletic instructional device of claim 1, wherein the rod and brace are formed as an integral piece.

9. A method for learning the proper positioning of a hand and a wrist relative to a forearm during an athletic maneuver, the method comprising:

securing a brace to an athlete such that the brace extends at least partially along a first forearm, a first wrist, and a first hand of the athlete;

grasping a rod with the first hand, wherein the rod and brace are coupled directly together to maintain the first hand in a desired, substantially constant orientation relative to the first forearm, and wherein the rod has a first weight and a second weight disposed at opposing ends thereof, such that the first hand is positioned between the first and second weights when the first hand grasps the rod; and performing the athletic maneuver, wherein the first hand and the first forearm are maintained in the desired, substantially constant orientation throughout the performance of the athletic maneuver.

10. The method of claim 9, further comprising grasping the rod with a second hand prior to performing the athletic maneuver, wherein the second hand is positioned between the first and second weights when the second hand grasps the rod.

11. The method of claim 9, further comprising replacing the second weight with an athletic device.

12. The method of claim 11, wherein the athletic device comprises a golf club, a resistance fan, or a combination thereof.

13. The method of claim 9, wherein the athletic maneuver comprises a golf swing.

14. The method of claim 9, wherein the desired, substantially constant orientation of the first hand relative to the first forearm is achieved when the brace is secured on the first forearm, the first hand grasps the rod, and the rod forms a generally right angle with the brace.

15. An athletic instructional device, comprising:

first and second means for maintaining a first hand of an athlete in a desired, substantially constant orientation relative to a first forearm of the athlete during an athletic maneuver, the first and second means being connected together, wherein the first and second means cooperate to substantially prevent the first hand of the athlete from moving in first and second directions relative to the first forearm, and wherein the first and second means cooperate to cause the first hand and the first forearm of the athlete to rotate together during the performance of the athletic maneuver;

a securing mechanism that selectively couples the first means for maintaining to the first forearm or first hand of the athlete; and first and second resistance mechanisms disposed at opposing ends of the second means for maintaining, such that the first hand of the athlete is disposed between the first and second resistance mechanisms during the athletic maneuver.

16. The athletic instructional device of claim 15, wherein the securing mechanism comprises a hook and loop fastening system or a stretchable fabric.

17. The athletic instructional device of claim 15, wherein the first means for maintaining comprises a brace that is wearable by the athlete and extends along at least a portion of the first forearm and the first hand.

18. The athletic instructional device of claim 17, wherein the second means for maintaining comprises a rod extending from the brace at a generally right angle.

19. The athletic instructional device of claim 18, wherein the first and second resistance mechanisms comprise, respectively, a first weight disposed at a first end of the rod and a second weight at a second end of the rod.

20. The athletic instructional device of claim 15, wherein at least one of the first and second resistance mechanisms is selectively replaceable with at least one of a golf club, a resistance fan, or a combination thereof.

* * * * *